US006392679B1

(12) United States Patent
Nanami

(10) Patent No.: US 6,392,679 B1
(45) Date of Patent: May 21, 2002

(54) THERMAL PRINTER

(75) Inventor: Shoji Nanami, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/903,689

(22) Filed: Jul. 13, 2001

(30) Foreign Application Priority Data

Jul. 13, 2000 (JP) ..... 2000-212566

(51) Int. Cl.[7] ..... B41J 2/36; B41J 29/17
(52) U.S. Cl. ..... 347/188; 347/171
(58) Field of Search ..... 347/171, 188; 400/701, 702

(56) References Cited

U.S. PATENT DOCUMENTS 5,995,126 A 11/1999 Imai

FOREIGN PATENT DOCUMENTS

JP 4-147870 5/1992 ..... B41J/2/36
JP 9-295420 11/1997 ..... B41J/2/32

OTHER PUBLICATIONS

English Language Abstract 04–147870 May 21, 1992.

*Primary Examiner*—Huan Tran
(74) *Attorney, Agent, or Firm*—Sughrue Mion, PLLC

(57) ABSTRACT

The thermal printer forms a recorded image in accordance with image data on a thermal recording material by using a thermal head. The thermal printer includes a first control mode for cleaning the thermal printer by using the thermal recording material and a second control mode for measuring density of the thermal printer by using the thermal recording material, in which the first and second control modes are switched at a partway of one piece of the thermal recording material. In the thermal printer various kinds of materials used for the processing of management, adjustment and maintenance can be used more effectively than before.

5 Claims, 3 Drawing Sheets

THERMAL PRINTER

BACKGROUND OF THE INVENTION

The present invention relates to a thermal printer, and more specifically, to a thermal printer that is able to efficiently clean a thermal head and create a conversion table for recording density correction.

A thermal image recording is utilized for recording of an ultrasonic diagnosis image, which is performed by using thermal (heat sensitive) recording material having a thermal recording layer formed on a supporting body such as a paper and a film. Moreover, since the thermal image recording has advantages that wet development is not necessary and that handling is easy, a range of its utilization has spread in the recent years in the image recording of medical diagnosis not only in a small image recording such as the ultrasonic diagnosis but also in applications where an image is required to be large in size and high in quality such as MRI (magnetic resonance imaging) diagnosis, X-ray diagnosis and the like.

As widely known, in the thermal image recording, a thermal head having a glaze where exothermic elements equivalent in number to the number of pixels in one line being arrayed in one direction is used. In the state where the glaze is pressed a little against the thermal recording layer of the thermal recording material, each exothermic element of the glaze is heated in accordance with image data of a recorded image while the thermal head and the thermal recording layer are relatively moved in a direction perpendicular to the array direction of the above-described exothermic elements. Thus, the thermal recording layer of the thermal recording material is heated to record the image.

Moreover, in the thermal printer, various processing for management, adjustment and maintenance are performed other than the actual image recording. Various kinds of materials are prepared in advance for the processing for management, adjustment and maintenance depending on applications thereof.

For example, when being recorded by pressing a heated thermal head against the thermal recording material, the image is recorded on the surface of the thermal recording material while the recording substance and lubricating substance of the thermal recording layer melt. Therefore, a stain and melted matter such as lubricant tend to be accumulated on the surface of the thermal head. There exists a problem that a recorded image becomes uneven if the melted matter builds up so much that it enters between the thermal recording material and the thermal head.

On the other hand, the melted matter adhered to the surface of the thermal head is gradually fixed on the surface due to continuous heating by the thermal head, and in some cases, the melted matter becomes so rigidly fixed that a cleaning solution cannot remove it easily. In such a case where removal of a fixed matter by the cleaning processing is difficult, the only solution has been to scrape off the fixed matter on the surface of the thermal head by using, for example, a lapping film having a strong abrasive power.

The above-described lapping film is the one in which abrasive agent such as alumina grains is adhered on the surface of the film as a supporting body, and by outputting the lapping film instead of the foregoing thermal recording material, the fixed matter on the surface of the thermal head can be scraped off. However, since the lapping film has such a strong abrasive power that it scrapes off even ceramic which is a protective coat of the thermal head, there exists a problem that wear of the thermal head becomes hastened and the life thereof becomes shortened.

Also, the lapping film has an advantage that it can remove a stubborn stain and fixed matter, but at the same time, has a drawback that it generates very large sound (noise) during operation. Therefore, there exists another problem that the lapping film is inappropriate for use in a hospital and the like. The assignee previously proposed an effective solution for the above-described various problems in Japanese Patent Application No. Hei8 (1996)-108944 "Thermal image recording apparatus" (refer to Japanese Patent Laid-Open No. Hei9 (1997)-295420 gazette).

In this solution, every time a specified number of the recorded images are formed, energy is not applied to the thermal head or energy lower than a predetermined value is applied thereto, and the thermal recording material is output to a thermal image recording apparatus. Thus, the thermal image recording apparatus is allowed to have a cleaning mode for cleaning the thermal head. Specifically, the thermal recording material is used instead of the foregoing lapping film in the state where the thermal head is not heated.

Also on the other hand, the thermal recording material is as well used in density correction which prevents fluctuation of an image density upon recording the image on the thermal recording material by driving the thermal head in accordance with an image signal. For example, a technology disclosed in Japanese Patent Application No. Hei2 (1990)-272924 "Method of density correction in image recording" (refer to Japanese Patent Laid-Open No. Hei4 (1992)-147870 gazette) applied by the assignee can be cited.

This method is a density correction method that is performed as follows. A plurality of density patterns are recorded on one piece of the thermal recording material at a front portion of with respect to a passage direction of the thermal head, before the image is recorded, and the density of each of the above-described density patterns is measured prior to the image recording on the thermal recording material. Based on the measurement result, a conversion table is created for performing a conversion processing of the image signal to be recorded on the thermal recording material. The above-described image signal is then subjected to the conversion processing by the conversion table when recording the above-described image on the thermal recording material on which the density patterns utilized for creating the conversion table are recorded.

In the above-described density correction method in the image recording, a plurality of density patterns (a kind of test patterns) for obtaining density data, which serves as a base for the density correction, are recorded on one piece of the thermal recording material prior to the actual image. The density of the recorded patterns is measured, and the conversion table for the density correction is created from a signal of the above-described density patters (a reference value for obtaining a predetermined density) and a density signal based on the density actually recorded.

As described above, in the thermal printer, various kinds of materials have been prepared in advance for processing for management, adjustment and maintenance, depending on applications thereof. However, there exists a problem that extra cost for maintenance and management is necessary other than the cost of the material itself in order to prepare in advance the various kinds of materials depending on each application.

SUMMARY OF THE INVENTION

The present invention has been created in consideration of the foregoing circumstances. The object of the present invention is to solve the problems in the prior art and to provide a thermal printer in which various kinds of materials used for management, adjustment and maintenance can be utilized more efficiently than before.

In order to attain the object described above, the present invention provides a thermal printer for forming a recorded image in accordance with image data on a thermal recording material by using a thermal head, comprising: a first control mode for cleaning the thermal printer by using the thermal recording material; and a second control mode for measuring density of the thermal printer by using the thermal recording material, wherein the first and second control modes are switched at a partway of one piece of the thermal recording material.

Preferably, the first control mode uses the thermal recording material without heating the thermal head at all.

Preferably, the second control mode allows the thermal head to perform heating for generating predetermined test patterns, density of which vary in a plurality of steps.

Preferably, the switching of the first and second control modes at a partway of one piece of the thermal recording material is performed from the second control mode to the first control mode.

Preferably, the switching of the first and second control modes at a partway of one piece of the thermal recording material is performed from the first control mode to the second control mode.

PREFERRED EMBODIMENTS OF THE INVENTION

Preferred embodiments of the present invention will be described in detail with reference to the drawings.

Figure 1:
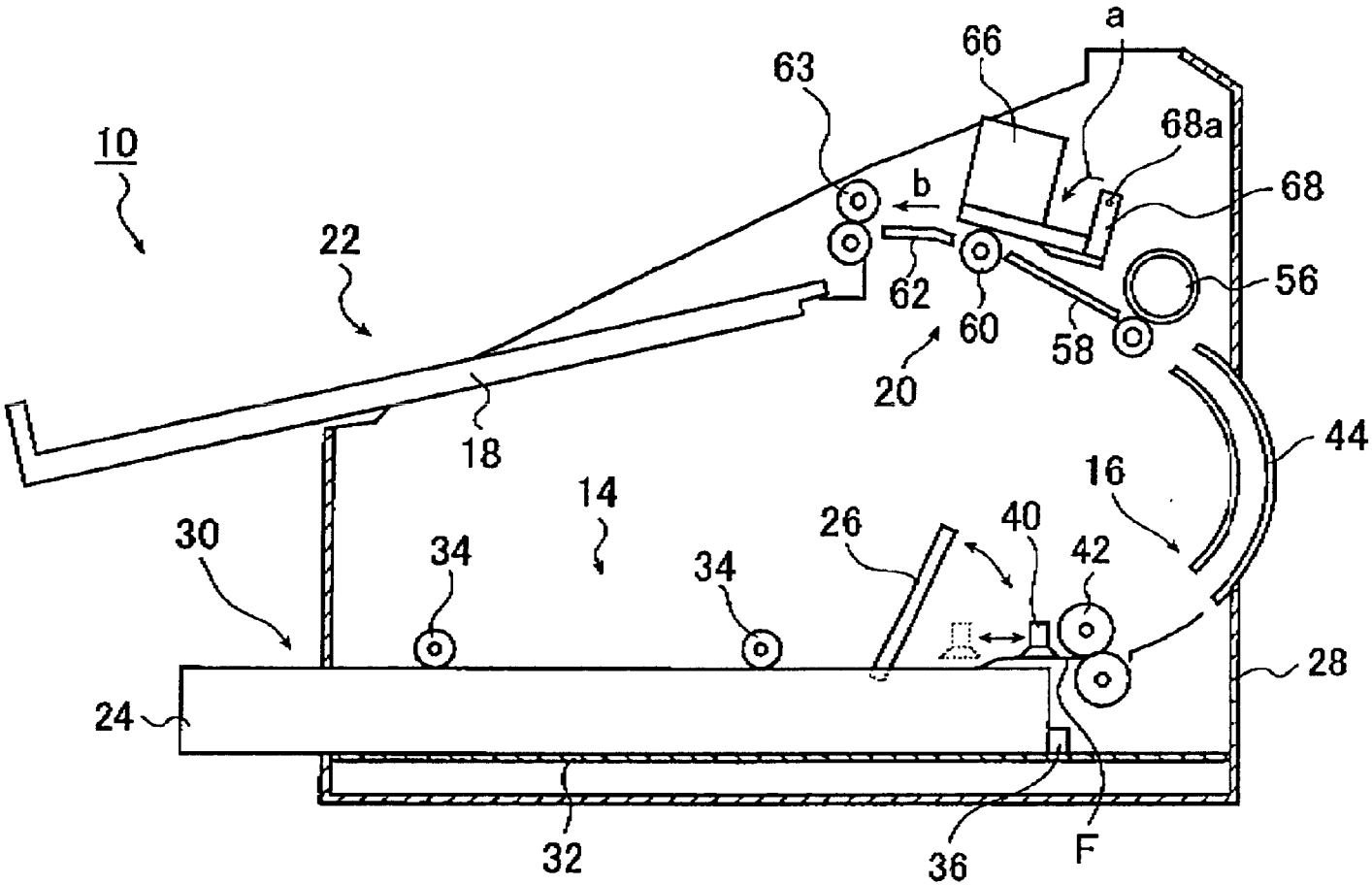
FIG. 1 is a conceptional view of a thermal printer according to one embodiment of the present invention.

FIG. 1 is a side sectional view showing a schematic constitution of a thermal printer according to one embodiment of the present invention. A thermal printer 10 in the drawing is the one to perform thermal image recording on a thermal recording material such as a thermal recording film F (hereinafter, simply referred to as a film) having a predetermined size (for example, B4 size and the like). The thermal printer 10 is constituted of a loading section 14 where a magazine 24 contains the above-described film F, a supply and conveyance section 16, a recording section 20 for performing the thermal image recording on the film F by a thermal head 66, an ejection section 22, and the like.

The above-mentioned film F is the one having transparent polyethylene terephthalate (PET) as a supporting body on which a thermal recording layer is formed on the entire surface thereof. For example, the film F is provided in a stacked body of predetermined unit of about one hundred pieces, and contained in the foregoing magazine 24. The film F is taken out one by one from the magazine 24 to be supplied for the thermal recording.

The loading section 14 includes: an insertion port 30 formed on a body 28 of the thermal printer 10; a guide and support plate 32; guide rolls 34 and 34; a stopper 36; and the like. The magazine 24 is inserted into the thermal printer 10 from the insertion port 30 of the loading section 14 with the lid 26 side first. Then the magazine 24 is pushed to the position where the magazine 24 abuts to the stopper 36 while being guided by the guide and support plate 32 and the guide rolls 34 and 34, and then is loaded to a predetermined position of the thermal printer 10.

The supply and conveyance section 16 is the one that takes out the film F from the magazine 24 loaded in the loading section 14, and conveys or transports it to the recording section 20. The supply and conveyance section 16 includes: a sheet-fed mechanism using a suction cup 40 for sucking the film F by suction; a conveying unit (conveyor) 42; a conveyance guide 44; a pair of cleaning rollers 56 positioned at the exit of the conveyance guide 44; and the like.

The conveying unit 42 is comprised of a conveyance roller and a nip roller pressed by the conveyance roller. A pair of the cleaning rollers 56 is a pair of rollers that is comprised of an adhesive rubber roller and a regular roller, which is used for removing dust adhered to the film F.

When a recording start is instructed in the thermal printer 10, an opening/closing mechanism (not shown) opens the lid 26 of the magazine 24, the sheet-fed mechanism using the suction cup 40 takes out one piece of the film F from the magazine 24, and an edge of the film F is supplied between the conveyance roller and the nip roller of the conveying unit 42. At the time when the film F is sandwiched between the conveyance roller and the nip roller, suction by the suction cup 40 is released, and the film F supplied is conveyed along the conveyance guide 44.

Note that, at the time when the film F to be supplied for recording is completely ejected from the magazine 24, the foregoing opening/closing mechanism closes the lid 26. Distance from the conveying unit 42 to a pair of the cleaning rollers 56, which is defined by the conveyance guide 44, is set a little shorter than the length of the film F in the conveyance direction. Thus, conveyance by the conveying unit 42 allows the edge of the film F to reach a pair of the cleaning rollers 56.

Herein, a pair of the cleaning rollers 56 may be stopped at first to make the edge of the film F stop at this position once. Specifically, it is a method as follows. The temperature of the thermal head 66 is confirmed at the time when the edge of the film F has reached a pair of the cleaning rollers 56, and conveyance of the film F by a pair of the cleaning rollers 56 is resumed if the temperature of the thermal head 66 is at a predetermined temperature. The film F is then conveyed to the recording section 20.

On the other hand, in a method where a pair of the cleaning rollers 56 is not stopped, the temperature of the thermal head 66 is confirmed to reach at the predetermined temperature beforehand (for example, by making the instruction of the recording start to the film F to be the occasion), and with the confirmation, conveyance of the film F is continued and the film F is controlled to be sent into the recording section 20.

The recording section 20 is constituted of the thermal head 66, a platen roller 60, a cooling fan (not shown) for cooling the thermal head 66, a guide 58, a guide 62, a pair of film ejection rollers 63, and the like.

The thermal head 66 is the one for performing thermal image recording with a recording (pixel) density of, for example, 300 dpi. The thermal head 66 includes: a thermal head body having the glaze where the heat generating (exothermic) elements are arrayed in one direction for performing thermal recording of one line on the film F; and a heat sink fixed to the thermal head body. Note that the thermal head 66 is supported by a support member 68 freely rotatable with a fulcrum 68*a* as a center in an arrow direction "a" and in the opposite direction of "a".

The platen roller 60 rotates at a predetermined image recording speed while holding the film F in a predetermined position, and conveys the film F in the direction (an auxiliary scanning direction) substantially perpendicular to the direction (a main scanning direction) of the glaze being arranged so as to extend.

The supporting member 68 is rotated upward (the direction opposite to the arrow direction "a") before the film F is conveyed to the thermal head 66, and the glaze of the thermal head 66 and the platen roller 60 are not in contact with each other. When a pair of the foregoing cleaning rollers 56 starts conveyance of the film F, the film F is conveyed while being guided by a pair of the cleaning rollers 56 and the guide 58.

When the edge of the film F is conveyed to a recording start position (a position corresponding to the glaze), the above-described supporting member 68 is rotated in the arrow direction "a", and the film F is sandwiched between the glaze of the thermal head 66 and the platen roller 60. Thus, the glaze is in a pressed state by the recording layer. Next, the film F is conveyed to an arrow direction "b" while being held in a predetermined position by the platen roller 60.

Each heat generating element of the glaze is heated in accordance with the recorded image, synchronizing with the conveyance. Thus, thermal image recording is performed onto the film F. The film F to which the thermal image recording has completed is conveyed by the platen roller 60 and a pair of the film ejection rollers 63 while being guided by the guide 62, and is ejected on a tray 18 of the ejection section 22 provided on the upper portion of the thermal printer 10.

The thermal printer 10 according to the present invention is basically constituted and operates as described above. Next, an operation of the thermal head 66 during cleaning, which is a characteristic operation of the thermal printer 10 according to the present invention, is described.

The thermal printer 10 according to the present invention includes: a first control mode (hereinafter, referred to as a cleaning mode) in which the film F is output without any recording thereon every time a predetermined number of images, for example, one hundred pieces, are recorded; and a second control mode (hereinafter, referred to as a density correction mode) in which predetermined test patterns, the density of which varies in a plurality of steps, for density measurement are recorded on the film F to be output, and the density is corrected based on the test patterns. Herein, the film F is used as the material for cleaning the thermal head 66 as described above.

Pigment, which serves as a protective coat of the film F, is mixed in the uppermost surface layer of the film F. The pigment is a solid substance that is not melted by the heat of the thermal head 66, and is mixed in the uppermost surface of the film F to prevent the thermal head 66 from fixing (adhering) to the film F when the thermal head 66 heats the film F. Thus, the thermal printer 10 can normally record the image on the film F.

As described above, the pigment is originally the one for preventing the thermal head 66 from adhering to the film F when the heated thermal head 66 is pressed to the film F. Therefore, when the image is normally recorded on the film F, a polymer film as the support body of the film F is in a softened state. Accordingly, the film F does not have the abrasive power like that of the lapping film even if the pigment (the solid matter) is mixed to the uppermost surface of the film F.

However, when the film F is output without applying energy to the thermal head 66 (that is, without heating the thermal head 66), the polymer material as the support body of the film F also remains in a solid state. In addition, the pigment is a very hard matter in comparison to the polymer material as the support body of the film F, although it is not as hard as the alumina grains adhered on the surface of the lapping film. Thus, the film F serves to function as a kind of lapping film having a weak abrasive power as described above.

In the thermal printer 10 according to the present invention, while utilizing the above-described characteristics of the film F, cleaning of the thermal head 66 is performed with the film F by switching the foregoing mode in a predetermined timing. At the same time, the image recording is performed on a portion of the film F so as to form the test patterns for the density correction.

Figure 2A:
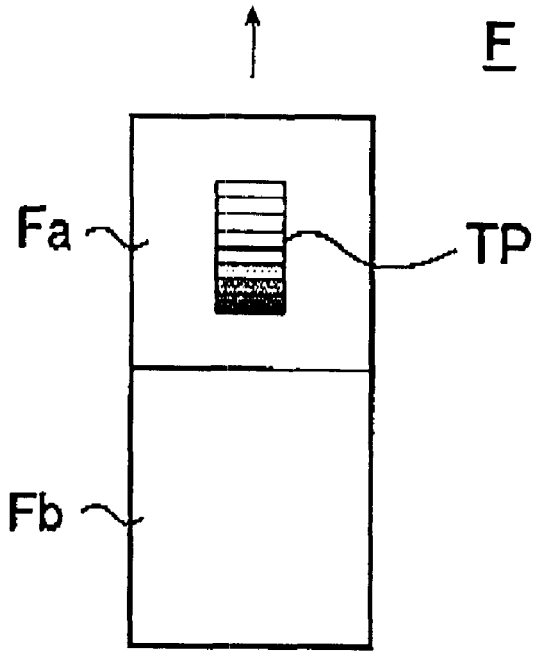
FIG. 2A and FIG. 2B are conceptional views showing examples of a film for cleaning and formation of test patterns to be output.

Specifically, as shown in FIG. 2A, the film F is output in the state that the image recording is performed on a front portion Fa of one piece of the film F so as to form test patterns TP for the density correction, and heat is not applied (no recording is made) to a remaining half, that is, a rear portion Fb as a cleaning film.

In other words, in this example, a portion (a test pattern recording portion) where the image recording has been performed so as to form the test patterns TP for the density correction is formed on the front portion Fa of the film F. With the test pattern recording portion, the conversion table for the density correction is created in the procedure described above. In addition, no recording is made on the rear portion Fb, which functions as the cleaning film.

Herein, the test patterns TP recorded on the film F, according to the shown example, uses patterns in which density is varied in eight steps. However, the present invention is not limited to this, but patterns may be used in which density is sequentially varied in a plurality of steps within a density range used in the thermal printer 10.

Figure 2B:
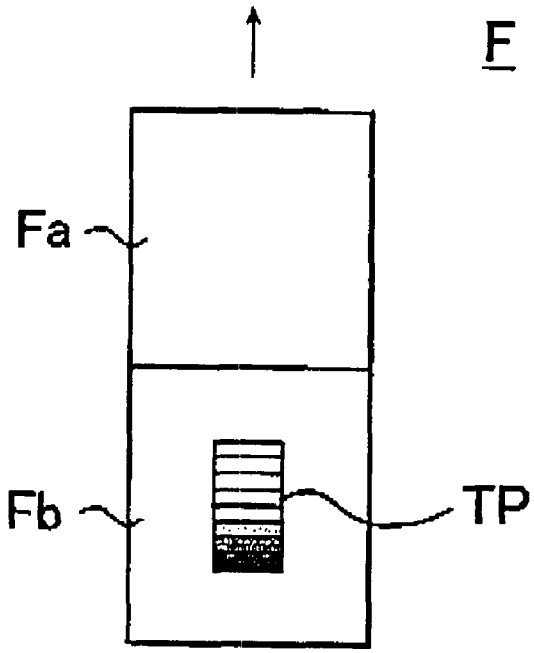

Note that FIG. 2B shows another specific example of the film F. In this example, contrary to the foregoing example, the film F is output in the state that heat is not applied (no recording is made) to the front portion Fa of one piece of the film F as a cleaning film, and image recording is performed on the remaining half, that is, the rear portion Fb so as to form the test patterns TP for the density correction.

Comparing the examples shown in FIG. 2A and FIG. 2B, cleaning is performed after the test patterns TP for the density correction are formed in the example shown in FIG. 2A, whereas the test patterns TP for the density correction are formed after cleaning is performed first in the example shown in FIG. 2B. Accordingly, although accuracy in formation of the test patterns TP may improve to some degree in the example of FIG. 2B, there is no substantial difference between the two examples and approximately the same effect can be obtained.

Note that switching between the above-described two modes may be made in a method where the switching is decided in advance depending on the passing of a processing time of the film F. In addition, application order of the two modes also may be decided in advance, or an operator can select either mode when switching is necessary. One example of an algorithm in this case is shown in FIG. 3.

Figure 3:
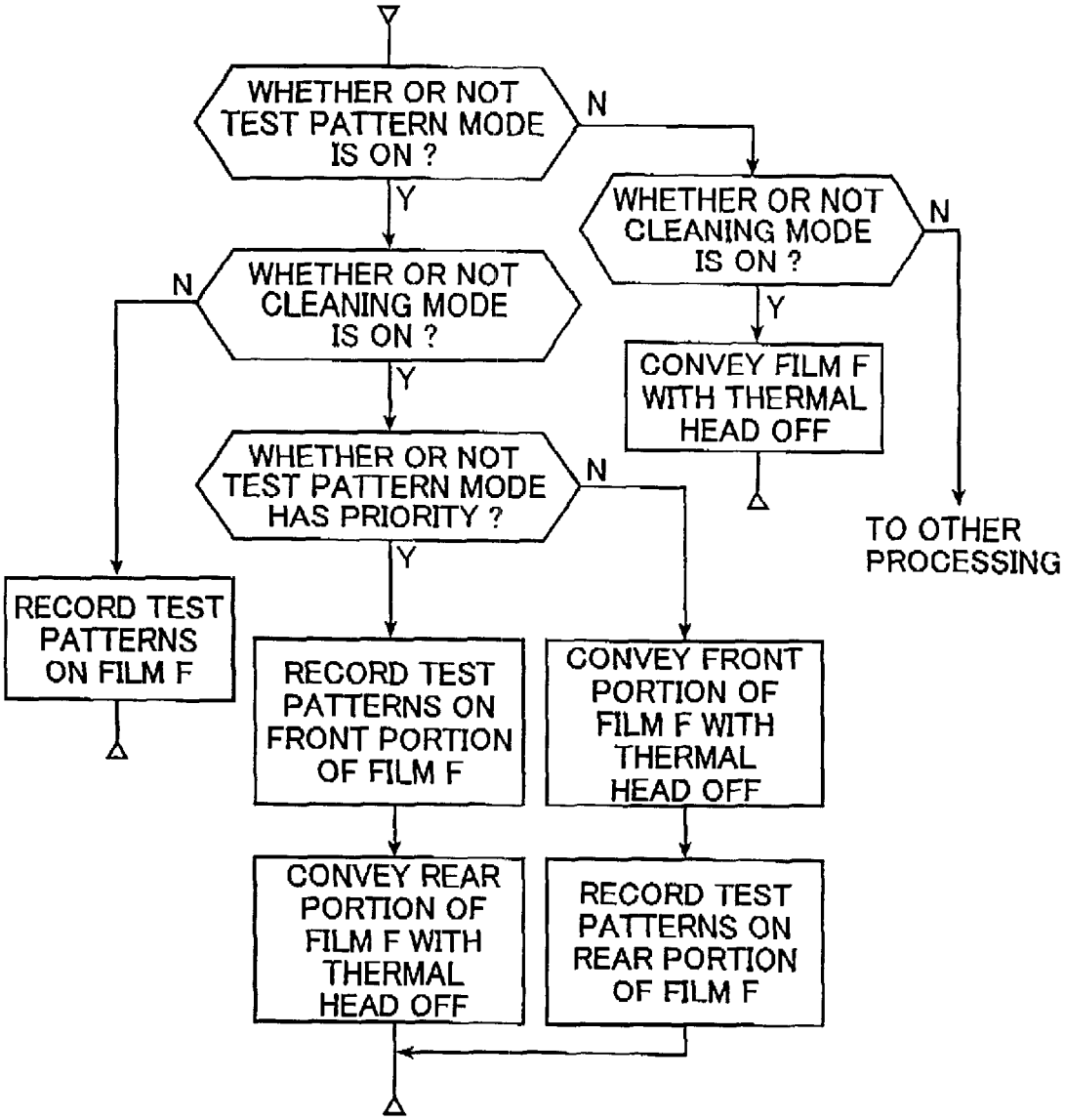
FIG. 3 is a diagram showing one example of an algorithm of a mode switching (selection).

In FIG. 3, activating the cleaning mode and forming the test patterns TP for the density correction are respectively abbreviated as "cleaning mode ON" and "test pattern mode ON". Moreover, selection of either mode is possible.

Furthermore, in the thermal printer 10, the cleaning mode is normally activated automatically and periodically. However, it is preferable that the cleaning mode is designed to be activated manually at any time.

In the thermal printer 10 according to this embodiment constituted as described above, it is preferable that the printer is appropriately set so as to output one piece of cleaning film every time a predetermined number of images are recorded. The film F to be output as the cleaning film is not limited at all. For example, the first piece, any piece in-between or the last piece of the films F contained in the magazine 24 may be output as the cleaning film.

Heretofore, the thermal printer according to the present invention has been described in detail by citing the embodiments above. However, the present invention is not limited to the foregoing embodiments, and various modifications and changes may be made without departing from the spirit and the scope of the present invention.

As described above in detail, according to the present invention, a significant effect is obtained that a thermal printer can be realized, in which various kinds of materials used for the processing of management, adjustment and maintenance can be used more effectively than before.

What is claimed is:

1. A thermal printer for forming a recorded image in accordance with image data on a thermal recording material by using a thermal head, comprising:

a first control mode for cleaning said thermal printer by using said thermal recording material; and a second control mode for measuring density of said thermal printer by using said thermal recording material, wherein said first and second control modes are switched at a partway of one piece of said thermal recording material.

2. The thermal printer according to claim 1, wherein said first control mode uses said thermal recording material without heating the thermal head at all.

3. The thermal printer according to claim 1, wherein said second control mode allows the thermal head to perform heating for generating predetermined test patterns, density of which vary in a plurality of steps.

4. The thermal printer according to claim 1, wherein the switching of said first and second control modes at a partway of one piece of said thermal recording material is performed from said second control mode to said first control mode.

5. The thermal printer according to claim 1, wherein the switching of said first and second control modes at a partway of one piece of said thermal recording material is performed from said first control mode to said second control mode.

* * * * *